US005277338A

United States Patent [19]

Divall

[11] Patent Number: 5,277,338

[45] Date of Patent: Jan. 11, 1994

[54] FLUID METERING APPARATUS

[75] Inventor: John E. Divall, Grove, England

[73] Assignee: Odin Developments Limited, Stevenage, United Kingdom

[21] Appl. No.: 809,589

[22] Filed: Dec. 17, 1991

[30] Foreign Application Priority Data

Dec. 21, 1990 [GB] United Kingdom ..... 9027059

[51] Int. Cl.[5] ..... F04B 7/00; F04B 39/10

[52] U.S. Cl. ..... 222/148; 222/278; 417/517; 417/538

[58] Field of Search ..... 222/255, 252, 278, 249, 222/250, 278, 1, 148; 417/517, 538

[56] References Cited

U.S. PATENT DOCUMENTS

| | | | |
|---|---|---|---|
| 208,192 | 9/1878 | McIntire | 417/517 |
| 1,003,256 | 9/1911 | Hardy | 222/250 |
| 1,531,698 | 3/1925 | Janes | 417/538 X |
| 1,699,494 | 1/1929 | Schmidt | 222/250 |
| 2,819,679 | 1/1958 | Wilson | 417/538 X |
| 2,882,999 | 4/1959 | Morgan | 222/249 X |
| 4,580,954 | 4/1986 | Boyle | 417/517 |
| 4,671,429 | 6/1987 | Spaanderman | 222/278 X |
| 5,071,326 | 12/1991 | Wright et al. | 417/517 |

FOREIGN PATENT DOCUMENTS

| | | | |
|---|---|---|---|
| 116024 | 12/1900 | Fed. Rep. of Germany | 222/249 |
| 1803310 | 11/1970 | Fed. Rep. of Germany | 222/278 |
| 2906300 | 8/1979 | Fed. Rep. of Germany | 222/249 |
| 359828 | 6/1938 | Italy | 222/249 |
| 164137 | 12/1964 | U.S.S.R. | 222/249 |

*Primary Examiner*—Kevin P. Shaver

*Attorney, Agent, or Firm*—Reising, Ethington, Barnard, Perry & Milton

[57] ABSTRACT

A metering apparatus, which may be single or double acting, includes a valve device including a closure member, an inlet port, an outlet port and one or two other ports communicating with a metering chamber of the single-acting apparatus or respective metering chambers of the double-acting apparatus. The closure member prevents communication between the inlet port and the outlet port during normal working, but, to allow flushing of the apparatus by cleaning fluid, the closure member can be displaced to an abnormal position in which the inlet port communicates with the outlet port by way of the other port(s).

8 Claims, 3 Drawing Sheets

FLUID METERING APPARATUS

BACKGROUND OF THE INVENTION

1. Field of the Invention

This invention relates to fluid flow control, particularly but not necessarily for use in metering apparatus for fluid.

2. Description of the Prior Art

EP-A-0280537 discloses a dosing system for filling containers with a particulate/liquid mixture. The system includes three single-acting piston-and-cylinder devices, of which a first device delivers the mixture downwards to containers advanced beneath it, a second device feeds a thick particulate/liquid mixture via a first conduit to the first device, and the third device feeds a thin liquid via a second conduit to a liquid supply port of the first device. The port is disposed peripherally in the cylinder of the first device and is swept by the piston thereof, and a conduit in continuous communication with the port extends through the piston to a lower axial end of the piston. One of the factors limiting the frequency of filling of the containers is the time taken to refill the second and third devices, which becomes relatively high for the second device with relatively viscous mixtures.

From GB-A-377939; GB-A-1305729; GB-A-1578981; FR-A-2068800; FR-B-2544491 and DE-B-1159341, for example, it is known to employ for metering purposes piston-and-cylinder arrangements which are double-acting in the sense that, while one metered dose is being delivered from one metering chamber, a second dose is being metered by another metering chamber and then, while that second dose is being delivered from the other chamber, a third dose is being metered by the one chamber. Of these, GB-A-377939; FR-A-2068800; FR-B-2544491 and DE-B-1159341 disclose that each arrangement includes a rotary change-over valve device which connects the fluid input to one metering chamber and the fluid output to the other metering chamber, and vice-versa, alternately. The valve device includes a cylindrical valve housing and a rotary closure member co-axially mounted in the housing. The housing is formed with four fixed ports, namely a fluid inlet port, a fluid outlet port, and two ports connected to the respective metering chambers. In FR-A-2068800; FR-B-2544491 and DE-B-1159341 the rotary valve device is disposed directly between the two metering chambers and the two pistons are disposed outwardly of the two chambers.

Cleaning of such apparatus in situ can be performed by treating a cleaning fluid as if it were the filling fluid(s) and thus causing it to flow through the apparatus along the path(s) of the filling fluid(s) by operating the whole of the filling system. However, with the known apparatus, the rate of flow therethrough would be relatively low, so that the metering chambers would be only poorly cleaned, to the extent that dismantling of the chambers could be necessary to clean them well. Moreover, the land(s) of the rotary valve device would be only poorly cleaned because they are in sealing contact with the valve housing throughout most of the normal operation of the filling system. Furthermore, if the cleaning fluid is hot, it may become cooled to an undesirable degree during the time taken for the normal reciprocatory operation of the metering arrangement.

SUMMARY OF THE INVENTION

According to one aspect of the present invention, there is provided a valve device comprising a valve housing having sealing surface means, first and second ports through said surface means, and a valve closure member in said housing displaceable between a position in which a land of said valve closure member co-operates with said sealing surface means to obstruct fluid flow between said first and second ports and another position in which said land is disposed at said second port with gaps between respective opposite sides of said land, on the one hand, and respective opposite edge portions of said sealing surface means bounding said second port, on the other hand, through which gaps fluid can flow through said second port.

According to another aspect of the present invention, there is provided a method of controlling fluid flow, comprising displacing a valve closure member to a position in which a land thereof co-operates with sealing surface means of a valve housing to obstruct fluid flow between first and second ports extending through the sealing surface means, and subsequently displacing the valve closure member into another position in which the land is disposed at the second port with gaps between respective opposite sides of said land, on the one hand, and respective opposite edge portions of said sealing surface means bounding said second port, on the other hand, whereby fluid can flow through said gaps and said second port.

Owing to the invention, it is possible to expose the second port and both sides of the land to fluid flow, which feature is particularly useful if a cleaning fluid is to be passed through the valve device.

According to a third aspect of the present invention, there is provided a valve device comprising a valve housing having a fluid inlet duct leading to a fluid inlet port in said housing, a fluid outlet duct leading from a fluid outlet port in said housing, and conduit means, and a valve closure member in said housing displaceable among a first position in which said member enables fluid flow from said inlet port to said conduit means but obstructs fluid flow from said inlet port to said outlet port and fluid flow from said conduit means to said outlet port, a second position in which said member enables fluid flow from said conduit means to said outlet port but obstructs fluid flow from said inlet port to said conduit means and from said inlet port to said outlet port, and a third position in which said member enables fluid flow from said inlet port to said conduit means and from said conduit means to said outlet port.

According to a fourth aspect of the present invention, there is provided a method of controlling fluid flow, comprising displacing a valve closure member to a first position in which said member enables fluid flow from a fluid inlet port in said housing to conduit means, but obstructs fluid flow from said inlet port to a fluid outlet port in said housing and from said conduit means to said outlet port, subsequently displacing the valve closure member into a second position in which said member enables fluid flow from said conduit means to said outlet port but obstructs fluid flow from said inlet port to said conduit means and from said inlet port to said outlet port, and subsequently displacing the valve closure member into a third position in which said member enables fluid flow from said inlet port to said conduit means and from said conduit means to said outlet port.

Owing to the invention, it is possible to produce a continuous fluid flow through the fluid inlet port to the conduit means and thence from the conduit means through the outlet port, which feature is particularly useful if a cleaning fluid is to be passed through the valve device, because then the fluid flow rate can be relatively high, which in itself gives better cleaning. Moreover, the increased turbulence produced by the high flow rate gives even better cleaning. Furthermore, the cleaning fluid has less time to become cool if hot.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENTS

Figure 1:
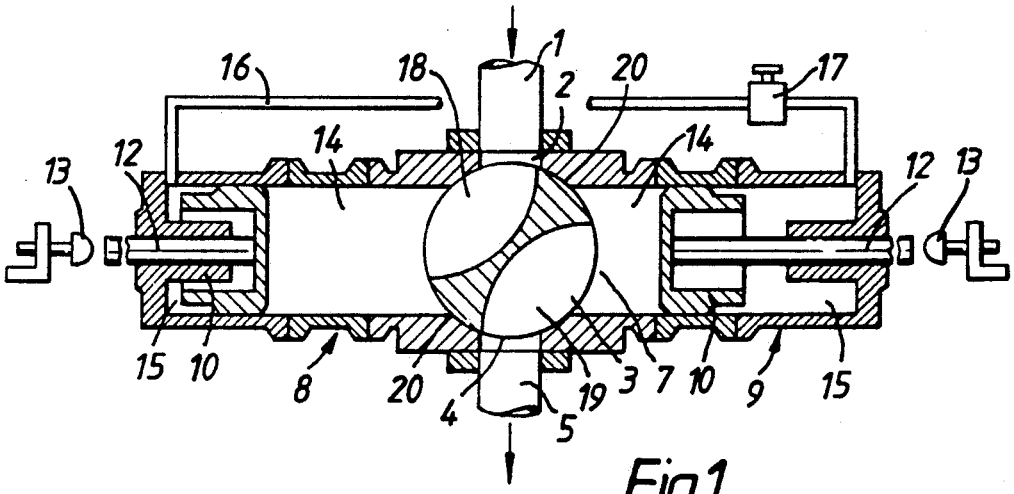
FIG. 1 shows a diagrammatic axial section through a metering apparatus for fluid, with a vane of a rotary plug valve in a metering position.

Two metering apparatuses, each as to be described with reference to the drawings, may replace the respective metering apparatuses 6 and 10 in U.S. Pat. No. 5,052,591.

Referring to the drawings, an inlet duct 1 extends to a fixed port 2 of an oscillating, rotary plug valve 3 having four fixed ports 2, 4, 6 and 7, and two movable ports 18 and 19. From an opposite fixed port 4 of the valve 3 extends an outlet duct 5. Connected to respective fixed ports 6 and 7 arranged at right-angles to the ports 2 and 4 are respective dosing devices 8 and 9. The devices 8 and 9 are in the form of respective piston-and-cylinder devices whereof the pistons 10 and the cylinders 11 are all co-axial with one another. The pistons have respective rods 12 which extend co-axially from the cylinders 11 towards respective adjustable stops 13. The devices 8 and 9 have respective metering chambers 14 communicating with the respective ports 6 and 7 and have respective drive chambers 15 at respective opposite sides of the pistons 10 from the chambers 14. The drive chambers 15 are interconnected via a drive pipe 16 and, together with the pipe 16, are full of a drive liquid, for example water. Connected in the pipe 16 is a flow rate regulating valve 17 for regulating the maximum flow rate of drive liquid through the pipe 16 between the chambers 15. In this version, the fluid to be metered is supplied under pressure to the inlet duct 1 and, in the condition of the valve 3 shown in FIG. 1 in which the port 2 is connected to the port 6 and the port 7 is connected to the port 4, forces back the piston 10 of the device 8, which in turn, via the pipe 16, forces forward the piston 10 of the device 9, until the piston rod 12 of the device 8 strikes the adjacent adjustable stop 13, whereby an electrical, hydraulic or pneumatic limit switch is actuated to cause change-over of the valve 3 into its other condition, in which the port 2 is connected to the port 7 and the port 6 is connected to the port 4, whereupon fluid is supplied from the inlet 1 to force back the piston 10 of the device 9 and thus to force forward the piston 10 of the device 8 to cause it to deliver the metered dose of fluid to the outlet duct 5. At the end of the stroke of the piston 10 of the device 9, the rod 12 of the device 9 strikes its adjustable stop 13 and thereby actuates an associated limit switch to turn the valve 3 into its condition shown in FIG. 1. Between the movable ports 18 and 19 are two lands 20 of a vane 21 of the valve 3 each of sufficient dimension circumferentially at its outer periphery that, during the change-over of the valve 3 between its two conditions, the ports 2 and 4 are fully closed before being opened again, as illustrated for the mid-position of the vane 21 shown in FIG. 2; thus there is no point in the cycle of operation of the valve 3 that the fluid could flow directly from the port 2 to the port 4. However, once a production run has been completed, the vane 21 can be turned out of its usual cycling range of oscillation into another mid-position shown in FIG. 3 in which gaps 22 exist between the respective opposite sides 23 and 24 of the lands 20, on the one hand, and those respective opposite edge portions 25 and 26 of the internal peripheral sealing surface 27 of the valve housing 28 bounding the ports 6 and 7, on the other hand. In this mid-position, a cleaning fluid can be passed through the duct 1 and the port 2 into the port 18, thence through the gaps 22 into the chambers 14, thence through the gaps 23 into the port 19 and thence to the outlet duct 5. In this way, highly effective cleaning can be obtained.

Other versions of the metering apparatus are possible. For example, a solid mechanical link could interconnect the pistons 10, rather than a drive liquid. Alternatively, the fluid need not be supplied under pressure to the inlet duct 1, if the link is provided with its own reciprocating drive, such as a rack-and-pinion drive.

Figure 2:
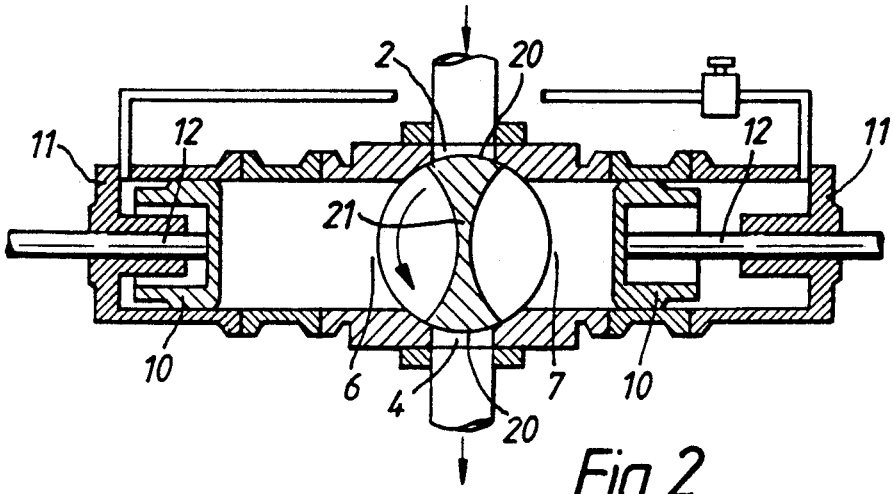
FIG. 2 is a view similar to FIG. 1 but showing the vane in a closed mid-position.
Figure 3:
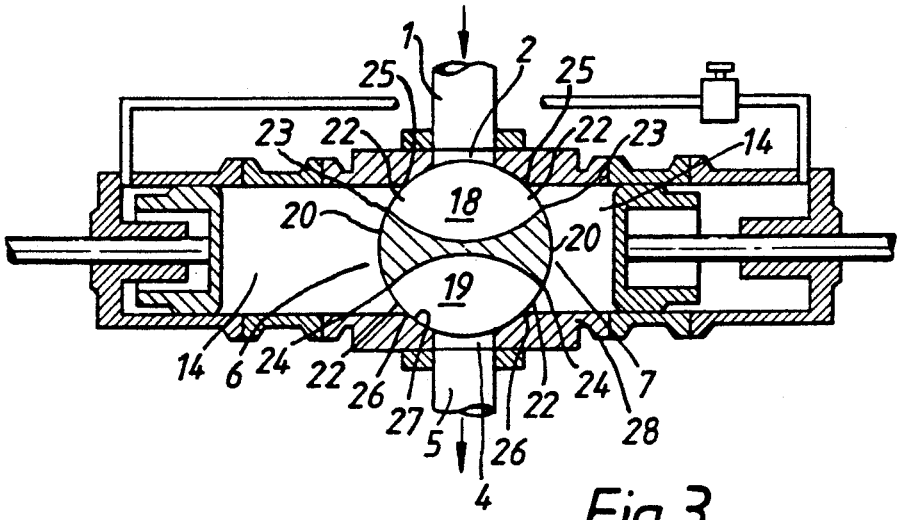
FIG. 3 is a view similar to FIG. 1 but showing the vane in a cleaning mid-position.
Figure 4:
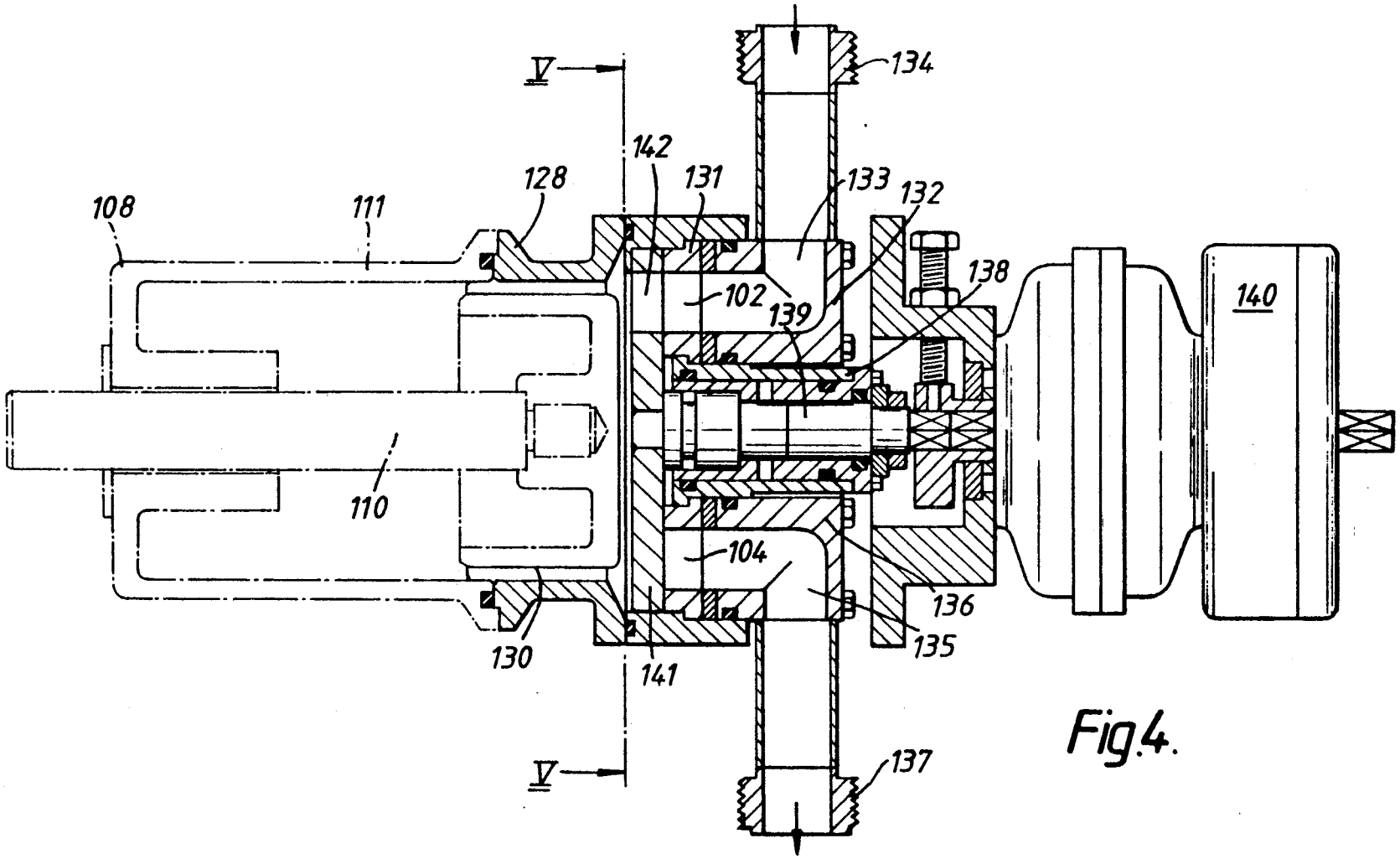
FIG. 4 shows, mainly in axial section, a rotary valve of a modified version of the metering apparatus, with an oscillatory plate of the valve in a metering position.
Figure 5:
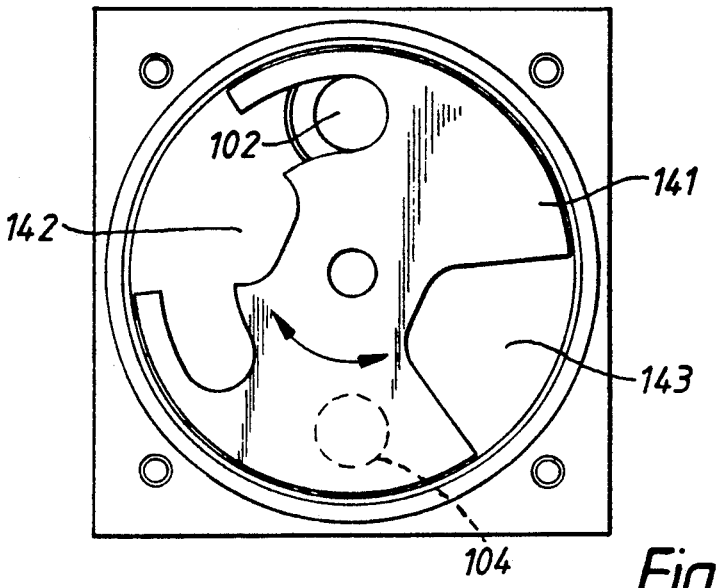
FIG. 5 shows a view taken on the line v—v of FIG. 4.
Figure 6:
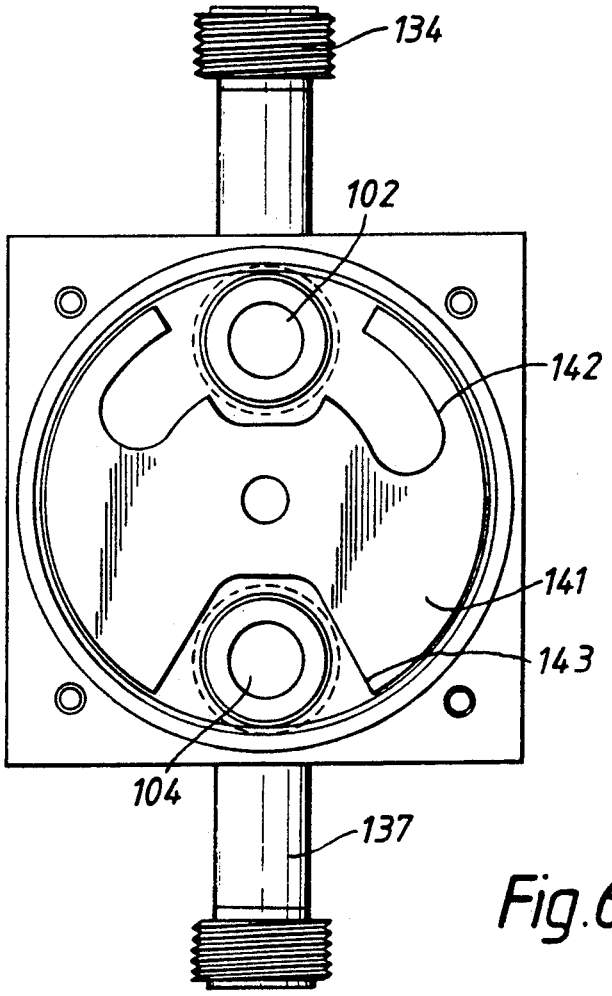
FIG. 6 shows a view similar to that of FIG. 5 but with the oscillatory plate turned to a cleaning position.

Referring to the modified version shown in FIGS. 4 to 6, a basic difference between this version and the version of FIGS. 1 to 3 is that the rotary valve controls flow in relation to a single metering device 108 shown in dot-dash lines in FIG. 4. The device 108 comprises a piston 110 and a cylinder 111 connected to a valve casing 128. Attached at its periphery between the cylinder 111 and the casing 128 is a rolling diaphragm 130 centrally attached to the head of the piston 110. Fixed to the casing 128 is a valve housing core comprised of a circular plate 131 formed with an inlet port 102 and an outlet port 104 arranged diametrically opposite each other. Fixed to the outside of the plate 131 is an inlet block 132 formed with a right-angle bend duct 133 communicating an inlet duct 134 with the inlet port 102. Similarly, a right-angle bend duct 135 in an outlet block 136 communicates the outlet port 104 with an outlet duct 137. A fixed central block 138 provides a bearing for a central spindle 139 drivingly connected at its outer end to an actuator 140 and drivenly connected at its inner end to an oscillatory valve closure plate 141. The closure plate 141 is formed peripherally with two diametrically opposite recesses 142 and 143 and during normal operation of the apparatus is oscillated by the actuator 140 between the cylinder-charging position shown in FIG. 5 and a cylinder-discharging position not shown. In the cylinder-charging position shown in FIG. 5, the inlet port 102 is fully open to the recess 142 and thence communicates with the product-receiving chamber of the metering device 108. In this position, the outlet port 104 is fully closed by the plate 141. In the cylinder-discharging position, the plate 141 has been turned through approximately one right angle to cause the plate 141 to close fully the inlet port 102 and to bring the outlet port 104 into full communication with the recess 142 and thence with the dosing chamber of the metering device 108, so that the product contained therein can be expelled through the outlet duct 137 by introduction of a driving fluid into the chamber to the rear of the piston head. The angular spacing between the cylinder-charging position and the cylinder-discharging position of the plate 141 and the dimensions of the recess 142 are such that there is not any time communication between the ports 102 and 104 throughout the oscillatory cycle between those two positions.

However, when it is desired to clean the fluid pathway through the apparatus, the plate 141 can be brought to the cleaning position shown in FIG. 6, in which the inlet port 102 is in full communication with the recess 142 and the outlet port 104 is in full communication with the recess 143. In this position, a cleaning fluid can be passed through the ducts 134 and 133, the port 102, the recess 142, the dosing chamber of the device 108, the recess 143, the port 104 and the ducts 135 and 137, a turbulent flow being directed into the dosing chamber.

Alternatively, instead of the valve device taking the form of a rotary valve, it could take the form of a linear slide valve.

I claim:

1. Metering apparatus, comprising:

inlet means for inflow of fluid, outlet means for outflow of metered does of said fluid, a dosing device serving to receive said fluid from said inlet means and to expel a dose of said fluid towards said outlet means, and a valve device comprising a valve housing having sealing surface means, first and second ports through said surface means and communicable with said dosing device and with said inlet means and said outlet means, and a valve closure member in said housing displaceable between a position in which a land of said valve closure member co-operates with said sealing surface means to obstruct fluid flow between said first and second ports and another position in which said land is disposed at said second port with gaps between respective opposite sides of said land, on the one hand, and respective opposite edge portions of said sealing surface means bounding said second port, on the other hand, through which gaps fluid can flow through said second port.

2. Metering apparatus according to claim 1, wherein, in the first-mentioned position, said land is disposed at said first port and said respective opposite sides of said land overlap respective opposite edge portions of said sealing surface means bounding said first port, whereby said land prevents fluid flow through said first port.

3. Metering apparatus according to claim 1, and further comprising third and fourth ports through said surface means, said valve closure member including a second land which in the first-mentioned position of said valve closure member co-operates with said sealing surface means to obstruct fluid flow between said third and fourth ports and in said other position is disposed at said third port with gaps between respective opposite sides of said second land, on the one hand, and respective opposite edge portions of said sealing surface means bounding said third port, on the other hand, through which latter gaps fluid can flow through said third port.

4. Metering apparatus according to claim 3, wherein, in said first-mentioned position, said second land is disposed at said fourth port and said respective opposite sides of said second land overlap respective opposite edge portions of said sealing surface means bounding said fourth port, whereby said second land prevents fluid flow through said fourth port.

5. Metering apparatus, comprising inlet means for inflow of fluid, outlet means for outflow of metered does of said fluid, a first dosing device serving to receive said fluid from said inlet means and to expel a dose of said fluid towards said outlet means, a second dosing device serving to receive said fluid from said inlet means and to expel a does of said fluid towards said outlet means, a change-over valve device comprising a valve housing having sealing surface means, first, second, third and fourth ports through said surface means communicating with said inlet means, said first dosing device, said second dosing device and said outlet means, respectively, and a valve closure member in said housing including surface portions defining first and second lands alternating with first and second recesses, said valve closure member being displaceable between a first position in which said first land co-operates with said sealing surface means to obstruct fluid flow between said first and second ports and said second land of said valve closure member co-operates with said sealing surface means to obstruct flow between said third and fourth ports, a second position in which said first land co-operates with said sealing surface means to obstruct fluid flow between said first and third ports and said second land co-operates with said sealing surface means to obstruct fluid flow between said second and fourth ports, and a third position in which said first land is disposed at said second port with gaps between respective opposite sides of said first land, on the one hand, and respective opposite edge portions of said sealing surface means bounding said second port, on the other hand, through which gaps fluid can flow through said second port and in which said second land is disposed at said third port with gaps between respective opposite sides of said second land, on the one hand, and respective opposite edge portions of said sealing surface means bounding said third port, on the other hand, through which latter gaps fluid can flow through said third port, whereby, in said first position said inlet means is connected to said second dosing device by way of said valve device and said first dosing device is connected to said outlet means by way of said valve device and in said second position said inlet means is connected to said first dosing device by way of said valve device and said second dosing device is connected to said outlet means by way of said valve device, and drive means for the first and second dosing devices and so arranged that, while said first dosing device is receiving said fluid from said inlet means, said second dosing device is expelling a dose of said fluid towards said outlet means, and vice-versa.

6. Metering apparatus, comprising:

inlet means for inflow of fluid outlet means for outflow of metered doses of said fluid, a dosing device serving to receive said fluid from said inlet means and to expel a dose of said fluid towards said outlet means, and a valve device comprising a housing having a fluid inlet duct leading to a fluid inlet port in said housing communicable with said dosing device, a fluid outlet duct leading from a fluid outlet port in said housing communicable with said dosing device, and conduit means, and a valve closure member in said housing displaceable among a first position in which said member enables fluid flow from said inlet port to said conduit means but obstructs fluid flow from said inlet port to said outlet port and fluid flow from said conduit means to said outlet port, a second position in which said member enables fluid flow from said conduit means to said outlet port but obstructs fluid flow from said inlet port to said conduit means and from said inlet port to said outlet port, and a third position in which said member enables fluid flow from said inlet port to said conduit means and from said conduit means to said outlet port.

7. Metering apparatus according to claim 6, wherein said valve closure member includes a land which only partially obstructs an entrance to said conduit means in said third position.

8. Metering apparatus, comprising inlet means for inflow of fluid, outlet means for outflow of metered doses of said fluid, a first dosing device serving to receive said fluid from said inlet means and to expel a dose of said fluid towards said outlet means, a second dosing device serving to receive said fluid from said inlet means and to expel a dose of said fluid towards said outlet means, a charge-over valve device comprising a valve housing having a fluid inlet port to which leads said inlet means, and a fluid outlet port leading to said outlet means, and a valve closure member in said housing including surface portions defining lands alternating with recesses and displaceable among a first position in which said member enables fluid flow from said inlet port to said second dosing device and from said first dosing device to said outlet port but obstructs fluid flow from said inlet port to said outlet port, fluid flow from said inlet port to said first dosing device, and fluid flow from said second dosing device to said outlet port, a second position in which said member enables fluid flow from said second dosing device to said outlet port and from said inlet port to said first dosing device but obstructs fluid flow from said inlet port to said second dosing device, fluid flow from said first dosing device to said outlet port, and fluid flow from said inlet port to said outlet port, and a third position in which said member enables fluid flow from said inlet port to said first and second dosing devices and from said first and second dosing devices to said outlet port, and drive means for the first and second dosing devices and so arranged that, while said first dosing device is receiving said fluid from said inlet means said second dosing device is expelling a dose of said fluid towards said outlet means, and vice-versa.

* * * * *